US006712202B2

(12) United States Patent
Muller et al.

(10) Patent No.: US 6,712,202 B2
(45) Date of Patent: Mar. 30, 2004

(54) METHOD FOR PRODUCING A TWO-CHAMBER ARRANGEMENT, AND SUCH A TWO-CHAMBER ARRANGEMENT

(75) Inventors: Hans-Jorg Muller, Braunfels/Bondaden (DE); Klaus Sommermeyer, Rosbach (DE); Bernd Eschenbach, Hattersheim (DE)

(73) Assignee: Fresenius Kabi Deutschland GmbH (DE)

( * ) Notice: Subject to any disclaimer, the term of this patent is extended or adjusted under 35 U.S.C. 154(b) by 236 days.

(21) Appl. No.: 09/925,894

(22) Filed: Aug. 9, 2001

(65) Prior Publication Data

US 2002/0023851 A1 Feb. 28, 2002

(30) Foreign Application Priority Data

Aug. 23, 2000 (DE) ..... 100 41 295

(51) Int. Cl.[7] ..... B65D 81/32

(52) U.S. Cl. ..... 206/219; 53/452; 604/410; 604/416

(58) Field of Search ..... 53/452, 455; 206/219–222, 206/568; 604/410, 416

(56) References Cited

U.S. PATENT DOCUMENTS

| | | | | | |
|---|---|---|---|---|---|
| 4,402,402 | A | * | 9/1983 | Pike | 206/219 |
| 5,257,986 | A | | 11/1993 | Herbert et al. | 604/416 |
| 5,536,469 | A | * | 7/1996 | Jonsson et al. | 206/568 |
| 5,706,937 | A | | 1/1998 | Futagawa et al. | 206/221 |
| 5,865,309 | A | | 2/1999 | Futagawa et al. | 206/219 |
| 5,996,782 | A | * | 12/1999 | Sperry et al. | 206/219 |
| 6,484,874 | B1 | * | 11/2002 | Kageyama et al. | 206/219 |

FOREIGN PATENT DOCUMENTS

| | | | |
|---|---|---|---|
| DE | 39 26 395 C1 | 3/1991 | A61J/1/10 |
| DE | 38 34 566 C1 | 7/1993 | B65D/81/32 |
| DE | G 94 01 288.1 | 4/1994 | B65B/29/10 |
| DE | 696 06 210 T2 | 5/2000 | A61J/1/10 |
| DE | 199 60 226 C1 | 5/2001 | A61M/39/10 |
| EP | 0 733 353 A | 9/1996 | A61J/1/00 |
| EP | 0 737 468 B1 | 5/2000 | A61J/1/10 |
| JP | 2000 197687 A | 7/2000 | A61J/1/00 |

* cited by examiner

*Primary Examiner*—Jim Foster
(74) *Attorney, Agent, or Firm*—Heslin Rothenberg Farley & Mesiti P.C.

(57) ABSTRACT

To produce a two-chamber arrangement having a first chamber, which is filled with a first component, and a second chamber, which is filled with a second component, two separate bags are sterilized and filled independently of each other with the first/second component. Only after the bags have been sterilized and filled are they connected to each other in such a way that the component contained in one chamber can be transferred into the other chamber so as to be able to mix the two components together. Once they have been filled, the first and second bags are preferably sealed with an openable peel seam, after which the bag ends are welded together.

12 Claims, 3 Drawing Sheets

Figures 1A, 1B, 1C:
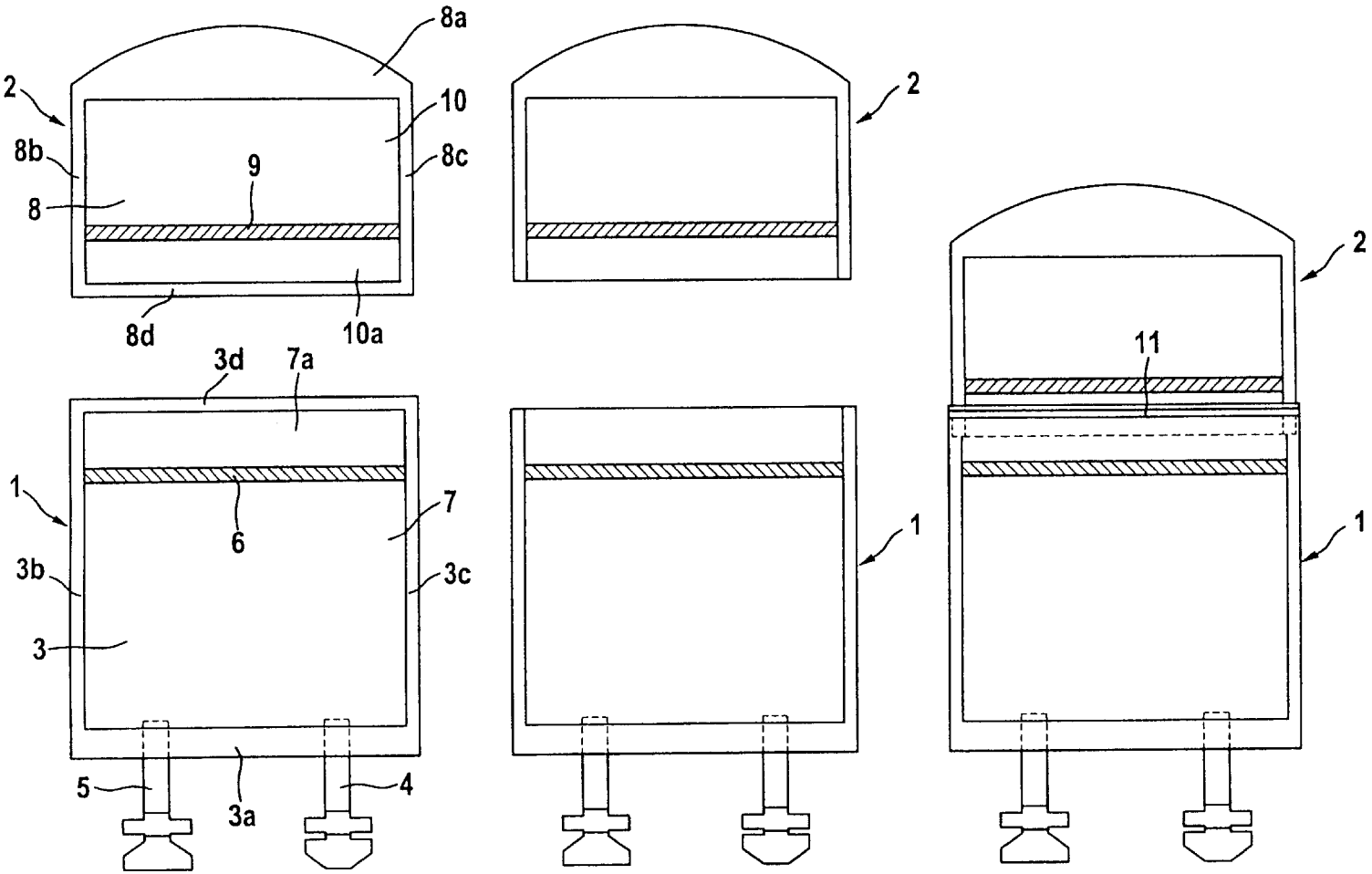

METHOD FOR PRODUCING A TWO-CHAMBER ARRANGEMENT, AND SUCH A TWO-CHAMBER ARRANGEMENT

The invention relates to a method for producing a two-chamber arrangement having a first chamber, which is filled with a first component, and a second chamber, which is filled with a second component. The invention moreover relates to such a two-chamber arrangement.

Two-chamber systems of this kind are used for example for storing substances for infusion therapy or for parenteral nutrition, which substances are intended to be mixed together shortly before administration. Multi-chamber bags are known for example from DE 32 38 649, DE 94 01 288 and EP 0,737,468.

A common feature of the known two-chamber bags is that they have two chambers which are separated by a peel seam. Upon use, the seam is opened so that the components contained in the chambers can be mixed together. To remove the content of the bag, a closable outlet opening is provided on one of the two chambers.

The known two-chamber bags have proven themselves in practice. However, if one of the two chambers is filled with a sensitive substance, the sterilization of the bag can prove problematic.

It is therefore an object of the invention to make available a method which permits simplified and cost-effective production of a two-chamber arrangement in large batch numbers. It is a further object of the invention to make available a two-chamber arrangement which can be produced easily and cost-effectively.

The method according to the invention is based on producing and filling not just one common bag with two chambers, but instead two separate bags each with only one chamber, said bags being connected to each other only at a later stage. Each bag can therefore be sterilized independently of the other and using different methods.

To produce the two-chamber arrangement, the first and second film bags are each sealed with an openable seam. The two bags are then joined together in such a way that, after the two seams have been opened, the two components can be mixed together. The two bags are preferably welded to each other after being filled. However, they can also be adhesively bonded to each other. Sealing each bag with an openable seam has the advantage that the content of the bag is securely enclosed before the bags are joined together.

The film bags can be made from superposed film webs connected to each other at their edges, or from a film tubing.

The first and second peel seams are preferably arranged in such a way that the salient bag films form pockets so that the bags can be easily connected to each other. The pockets are preferably sealed in order to keep the bags free from particles. The bag films are advantageously prevented from sticking together by means of an air cushion.

For the production of antibiotics or cytostatics, the first bag can be filled with a carrier solution and the second bag can be filled with an active powder substance independently of each other and at different locations. The first bag can be autoclaved at relatively high temperatures in a known manner and the second bag can be radiosterilized before filling. After the two bags are connected, the two-chamber arrangement again forms a user-friendly unit which allows the component contained in one chamber to be transferred into the other chamber.

It is advantageous if the first bag containing the carrier solution is made from a weldable polyolefin film, while the second bag receiving the moisture-sensitive active powder substance is made of a water-absorbing and oxygen-absorbing aluminum composite film. In order to be able to weld the aluminum film too, the latter is preferably provided with an appropriate coating.

The two-chamber arrangement can be incorporated as a primary bag into a secondary bag with appropriate barrier properties. Oxygen-absorbing bags can also be provided between primary packing and secondary packing.

In a second embodiment, the two bags are connected by means of a tubular connection piece which is sealed with a detachable part. One end of the connection piece is inserted into the first bag, and the part of the connection piece protruding beyond the bag is advantageously protected by a protective cap which is removed before the other end of the connection piece is inserted into the second bag.

In a further alternative, a first connector piece is inserted into the first bag, and a second connector piece is inserted into the second bag, and these connector pieces are connected to each other, for example screwed together or plugged one into the other, for the purpose of mixing the two components together.

Figure 2B:
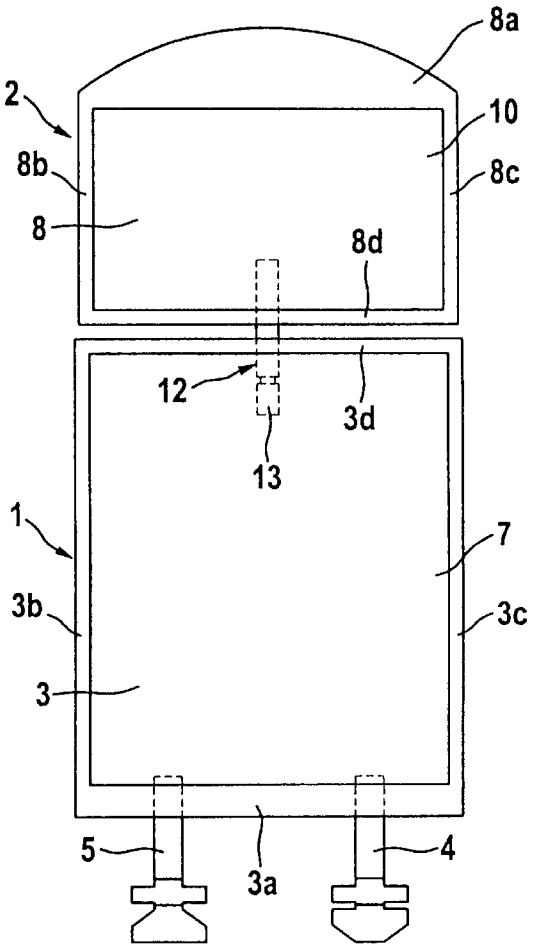
Figure 2A:
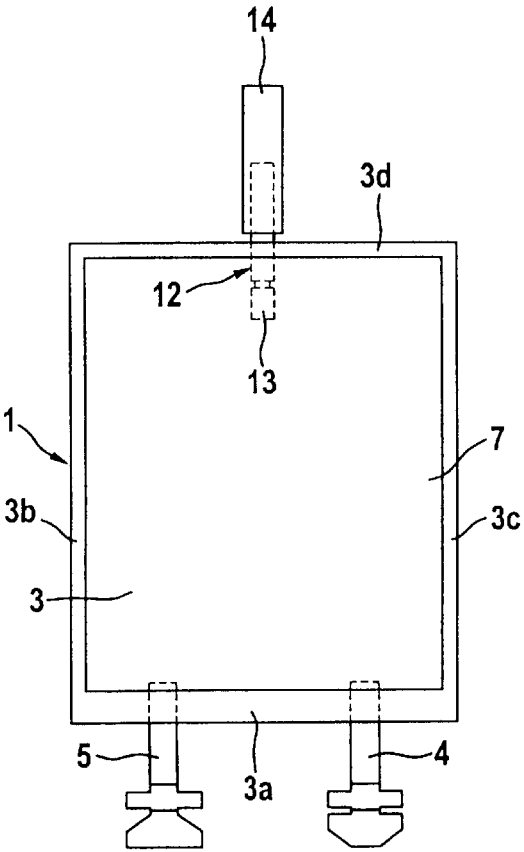
Figure 3B:
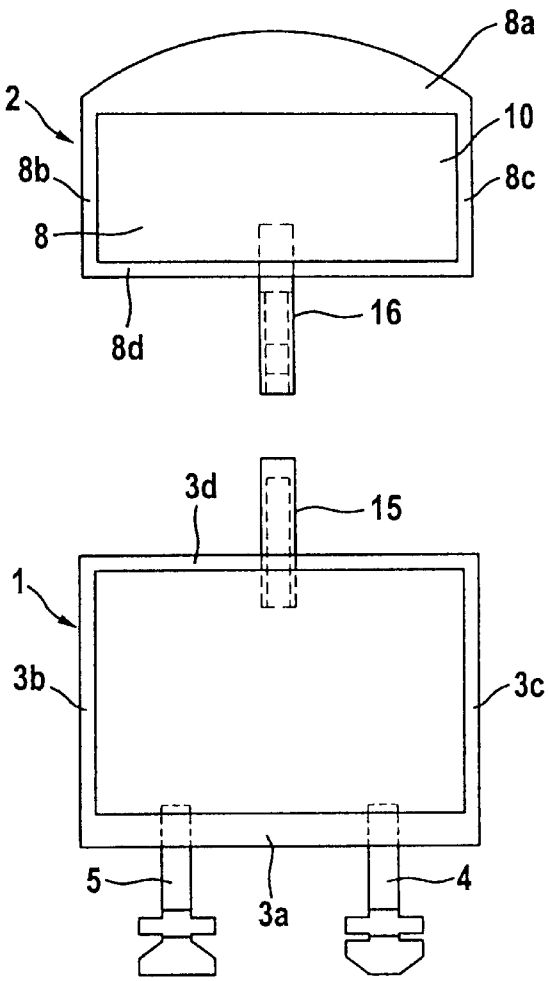
Figure 3A:
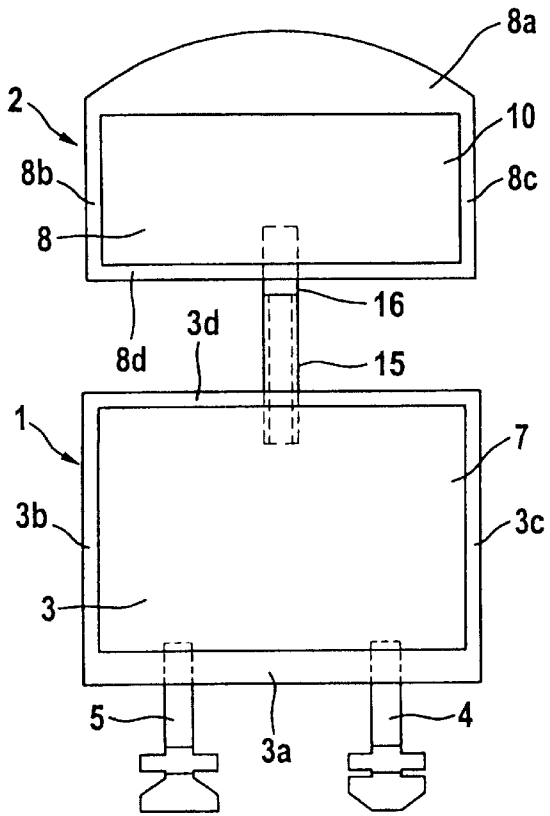

The invention is explained in greater detail below with reference to the drawings, in which:

FIGS. 1*a* to 1*c* show the individual steps involved in producing a first embodiment of the two-chamber arrangement, FIGS. 2*a* and 2*b* show the steps involved in producing a second embodiment of the two-chamber arrangement, and FIGS. 3*a* and 3*b* show the steps involved in producing a further embodiment of the two-chamber arrangement.

FIGS. 1*a* to 1*c* show the individual steps involved in producing a first embodiment of the two-chamber arrangement in a greatly simplified representation. The two-chamber arrangement comprises two separate film bags 1, 2 which are filled and sterilized independently of each other.

The first film bag 1 is made up of two superposed polyolefin films 3 which are initially sealed together only at the lower edge 3*a* and the side edges 3*b*, 3*c*. A removal part 4 for attachment of an infusion line (not shown) for removing liquid, and an injector part 5 for introducing liquid by means of an injection needle (not shown), are welded into the lower edge 3*a* of the bag. The removal part and injector part are described individually in DE 197 28 775, to which reference is expressly made. The open bag 1 is now filled with a carrier solution and is provided in the area of its upper edge 3*d* with a peel seam 6 which extends between the side edges 3*b*, 3*c* and seals a first chamber 7 containing the carrier solution. The films 3 are then also sealed together at the upper edge to form a first pocket 7*a*. The seam for sealing the first pocket is labeled 3*d*. The bag is finally autoclaved at 121° C.

The superposed films lying between the peel seam 6 and the outer sealing seam 3*d* are reliably prevented from sticking together during autoclaving by means of filling the first pocket 7*a* with air. With a small quantity of air between them, the two films no longer make contact. However, this is only necessary if the films have a tendency to stick together.

The second bag 2 has two superposed aluminum composite films 8 with oxygen-absorbing and moisture-absorbing layers. The composite films are also provided on their inside with an appropriate coating so that the films 3, 8 can be welded together. The aluminum composite films 8 of the second bag 2 are sealed together at the upper edge 8*a* and at the side edges 8*b*, 8*c*, and the bag is radiosterilized. The aluminum bag is then filled with the active powder substance under aseptic conditions, if appropriate under a protective nitrogen atmosphere and with exclusion of moisture. The bag is now provided in the area of its lower edge 8*d* with an openable peel seam 9 which extends between the side edges 8*b,* 8*c* and seals a second chamber 10 containing the active powder substance. The bag films 8 are then sealed together also at the lower edge in order to form a second pocket 10*a*. The sealing seam for closing the pocket is labeled 8*d* (FIG. 1*a*).

In a second step, carried out under appropriate clean-room conditions, the first and second bags 1, 2 are joined together (FIG. 1*b*). To do this, the salient edges of the bag films of the first/second bags are cut along the sealing seams 3*d,* 8*d*. The open end of the first bag 1 is then pushed over the open end of the second bag 2 and both bags are welded together with an all round sealing seam 11. The area between the two peel seams 6, 9 of the first and second bags 1, 2 is sterilized again. To do this, a sterilization method is used which makes use of light flashes with a suitable spectral energy distribution. After filling, this method can also be used to once again sterilize the two bags in the area of the pockets 7*a,* 10*a*. Since the compartments are sterilized by the light-flash sterilization method, the cutting of the salient edges of the bag films does not need to be done under strictly aseptic conditions, although the work must as far as possible be free of microorganisms and particles.

FIG. 1*c* shows the finished two-chamber bag which, as a primary bag, can be incorporated, together with one or more oxygen-absorbing bags, into a secondary bag with appropriate barrier properties.

When in use, the two peel seams 6, 9 of the two-chamber arrangement are opened by pressure, and the active powder substance is transferred from the second chamber 10 into the first chamber 7. After the active powder substance has dissolved in the carrier solution, the content of the bag can be removed via an infusion line which is attached to the removal part 4. The injector part 5 permits further supply of additional substances.

FIGS. 2*a* and 2*b* show the method steps involved in producing a second embodiment of the two-chamber arrangement which differs from the first embodiment in that the two bags are not welded together, but instead are connected to each other by means of a tubular connection piece 12. Nor are the chambers of the first and second bags sealed with peel seams. One end of the radiosterilized connection piece 12 is sealed by a detachable part 13, while the other end is protected by a detachable protective cap 14. The parts of the embodiment according to FIGS. 2*a* and 2*b* which correspond to the parts of the illustrative embodiment according to FIGS. 1*a* to 1*c* have been given the same reference labels.

After the first bag 1 has been filled with the carrier solution, the end of the connection piece 12 provided with the detachable part 13 is welded into the upper edge 3*d* of the first bag. The protective cap 14 extends over the whole area of the connection piece protruding from the first bag. The first bag is then autoclaved.

In a separate step, the radiosterilized second bag 2, which is not yet sealed at the lower edge 8*d,* is filled with the active powder substance. The protective sleeve 14 is then removed from the connection piece 12 under aseptic conditions and the free end of the connection piece is welded to the lower edge 8*d* of the second bag 2.

In order to mix the active powder substance and carrier solution together, the detachable part 13 is broken off from the connection piece 12 and the active powder substance is transferred from the second bag 2 into the first bag 1.

A further variant is shown in FIGS. 3*a* and 3*b*. Corresponding parts are once again provided with the same reference labels. The first and second bags 1, 2 are connected via two connector pieces 15, 16, shown diagrammatically. The two connector pieces 15, 16 are sealed tight before screwing, and they open only upon production of the screw connection. For example, the connector pieces can be sealed by means of detachable parts. Both connector pieces are radiosterilized.

The first bag 1 is filled with the carrier solution and sealed at its upper edge 3*d*. During the welding operation, one end of the first connector piece 15 is welded to the upper edge 3*d*. The first bag is then autoclaved again.

In a separate step, the radiosterilized second bag 2 is filled with the active powder substance under aseptic conditions. The lower edge 8*d* of the second bag is then sealed. One end of the second connection piece 16 is welded into the lower edge.

In use, the two connection pieces 15, 16 are connected reversibly to each other so that active powder substance and carrier solution can be mixed together.

What is claimed is:

1. A method for producing a two-chamber arrangement having a first chamber, which is filled with a first component, and a second chamber, which is filled with a second component, said method comprising the following method steps:

forming a first film bag, which has the first chamber, filling the first chamber with the first component, sealing the first chamber with a first openable seam, and inserting an attachment piece for removing content of the bag into the first bag;

forming a second film bag, which has the second chamber, filling the second chamber with the second component, and sealing the second chamber with a second openable seam;

forming a first sealed pocket between said first openable seam and a third seam of the first film bag;

forming a second sealed pocket between said second openable seam and a fourth seam of said second film bag; and opening the first pocket along the third seam and opening the second pocket along the fourth seam, and joining the first and second bags together in such a way that, after the first and second seams have been opened, the component contained in the first/second chamber can be transferred into the second/first chamber.

2. The method as claimed in claim 1, wherein the first pocket is opened along the third seam and the second pocket is opened along the fourth seam before the first and second bags are joined together.

3. The method as claimed in claim 1, wherein the first sealed pocket is filled with air.

4. The method as claimed in claim 1, wherein the first and second film bags are welded to each other.

5. The method as claimed in claim 1, wherein the first chamber is filled with a carrier solution and the second chamber is filled with an active powder substance.

6. The method as claimed in claim 1, wherein the first and second film bags are sterilized independently of each other and by different methods.

7. The method as claimed in claim 6, wherein the first bag is autoclaved and the second bag is radiosterilized.

8. The method as claimed in claim 1, wherein the first bag is made from a polyolefin film and the second bag is made from an aluminum composite film.

9. The method of claim 2, wherein said first and second bags are joined together at the opened first pocket and the opened second pocket.

10. The method of claim 9, further comprising sterilizing an area between the first openable seam and the second openable seam after the first and second bags are joined together.

11. The method of claim 10, wherein said sterilizing comprises light-flash sterilizing.

12. A two-chamber arrangement having a first chamber, which is filled with a first component, and a second chamber, which is filled with a second component, comprising:

a first film bag forming the first chamber and having a first openable seam for sealing the first chamber, and a first pocket extending outward from said first openable seam; an attachment piece inserted into the first film bag for removing content of the bag; and a second film bag forming the second chamber and having a second openable seam for sealing the second chamber, and a second pocket extending outward from said second openable seam;

wherein the first and second film bags are joined together by the first and second pockets in such a way that, after the first and second seams have been opened, the component contained in the first/second chamber can be transferred into the second/first chamber, and wherein said first bag includes a third seam for sealing said first pocket, said second bag includes a fourth seam for sealing said second pocket, and said first and second pockets are unsealed along said third seam and said fourth seam, respectively, before the first and second bags are joined together.

* * * * *